US005342726A

United States Patent [19]

Lima-Marques

[11] Patent Number: 5,342,726

[45] Date of Patent: Aug. 30, 1994

[54] METHOD OF TRANSFER OF IMAGE DEPOSITS FROM FERRO ELECTRIC RECORDING MEMBER SURFACES

[75] Inventor: Luis Lima-Marques, Henley Beach, Australia

[73] Assignee: MAN Roland Druckmaschinen AG, Offenbach am Main, Fed. Rep. of Germany

[21] Appl. No.: 747,688

[22] Filed: Aug. 20, 1991

[30] Foreign Application Priority Data

Aug. 23, 1990 [AU] Australia ..... PK1911

[51] Int. Cl.[5] ..... G03G 13/16

[52] U.S. Cl. ..... 430/126; 355/273; 101/487

[58] Field of Search ..... 355/256, 257, 271, 273; 430/126, 130, 31, 102; 101/39, 487; 118/621-641

[56] References Cited

U.S. PATENT DOCUMENTS

| | | | |
|---|---|---|---|
| 3,605,690 | 9/1971 | Staller | 118/59 |
| 3,824,098 | 6/1972 | Bergman et al. | 96/1.5 |
| 3,899,969 | 8/1975 | Taylor | 101/130 |
| 3,909,258 | 9/1975 | Kotz | 96/1 R |
| 3,935,327 | 1/1976 | Taylor | 427/19 |
| 5,183,619 | 2/1993 | Snelling | 346/153.1 |

FOREIGN PATENT DOCUMENTS 59-019978 5/1984 Japan .

OTHER PUBLICATIONS

Bergman et al. "Pyroelectric Copying Process", Appl. Phys. Lett., vol. 21, No. 10, 1972, pp. 497–499.

*Primary Examiner*—Marion E. McCamish
*Assistant Examiner*—Rosemary Ashton
*Attorney, Agent, or Firm*—Frishauf, Holtz, Goodman & Woodward

[57] ABSTRACT

To facilitate transfer of a toner adhered to a ferro-electric recording member on a cylindrical carrier to a substrate web, for example a paper web, a temperature difference is established at the recording member between a toning station, where toner is applied to the ferro-electric surface and a transfer station where the toner is transferred to the substrate web. This temperature difference may be as small as 0.3° C., but may be a few degrees C, in dependence on the printing speed, that is, speed of transfer from the cylindrical recording member to the paper web. The temperature difference may be obtained by applying a cooling element (10, 11) towards the ferro-electric layer (2) of the recording member, or a heater, or for example hot air (16) between the transfer station and retoning of the ferro-electric recording member at the toning station.

10 Claims, 1 Drawing Sheet

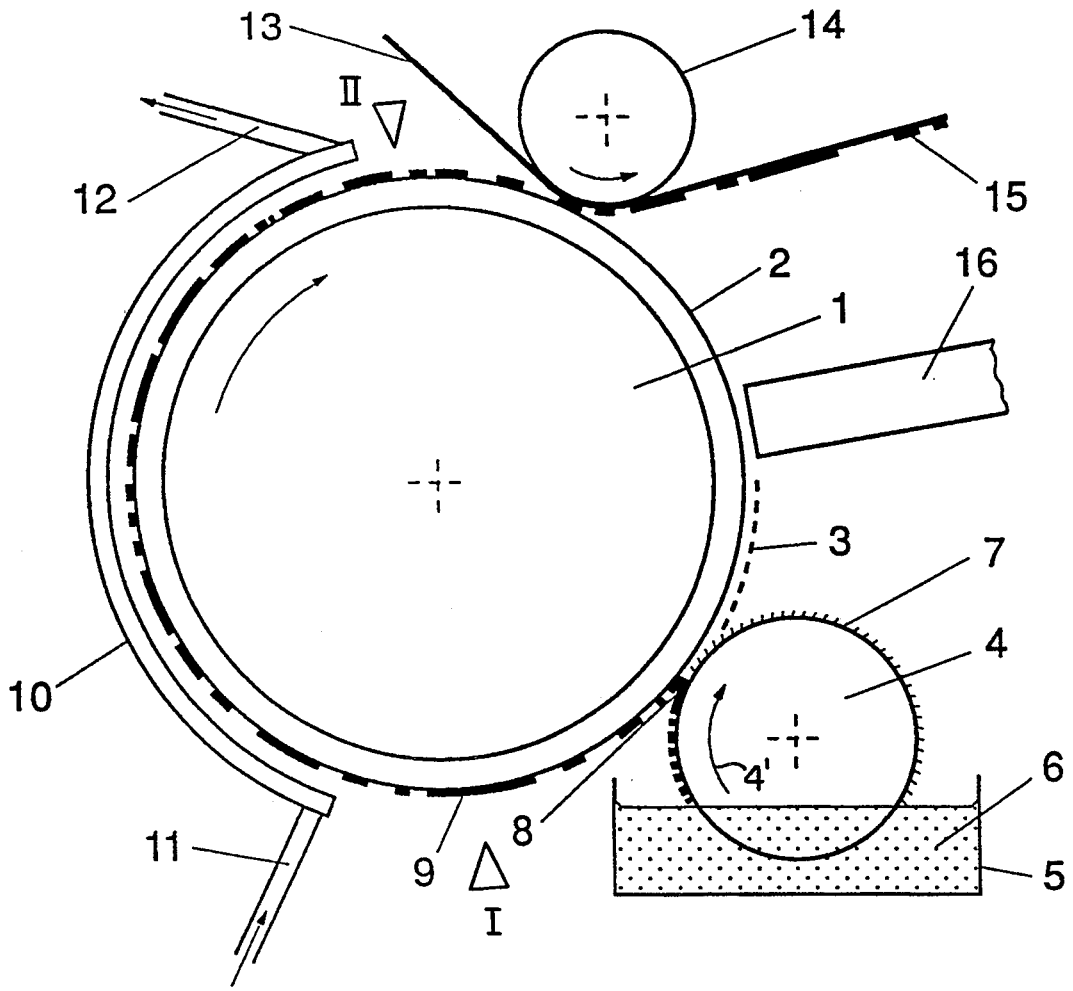
13
14
II
12
15
2
16
1
3
7
4
10
4'
6
11
9
8
5
I

METHOD OF TRANSFER OF IMAGE DEPOSITS FROM FERRO ELECTRIC RECORDING MEMBER SURFACES

FIELD OF THE INVENTION

The present invention relates to transfer of toned image deposits formed on the surface of a ferroelectric recording member in accordance with polarization of ferroelectric domains of said ferroelectric recording member based on images defined by respective polarizations to a receiving member, typically a paper web, engaged against the surface of the recording member, in which toner particles are applied against the surface of the recording member, adhered thereon in accordance with the image and, upon engagement with the substrate web, transferred to the substrate web.--;

BACKGROUND

It is known to produce toned image deposits on the surface of a ferro-electric recording member, such ferro-electric recording member having a permanent latent image impressed on or about its surface by way of internal polarization of ferroelectric domains. This polarization may be of the positive type, positively charged toner particles being repelled therefrom, or of the negative type to which positive toner particles are attracted and attached. The latent image may also be a combination of both types of polarization.

The toned image deposit is subsequently transferred to a receiving member, either directly or with use of an intermediate offset transfer member. Electrostatic transfer is one well known prior art transfer method. Toning and transfer methods suitable for use with ferro-electric recording members are referred to in Australian Provisional Patent Application No: PK0308, now U.S. Pat. No. 5213931.

Electrostatic transfer of image deposits from toned recording member surfaces is a very satisfactory method when a small number of copies are required, or when the ferro-electric member is periodically repolarized as transfer voltage and transfer pressure need only be adjusted to obtain maximum transfer efficiency. However such transfer conditions may result in degradation of the latent image on the recording member surface, resulting in successive lowering in image quality in those instances when it is required to produce a multiplicity of copies from a single latent image.

THE INVENTION

It is an object of the invention to provide a method and means whereby the disadvantages of electrostatic transfer may be overcome, and allows the electrostatic transfer field to be reduced substantially, and even to be completely eliminated.

Briefly, the invention is based on the phenomenon that the electric properties of ferro-electric material can be enhanced by an increase in temperature. The surface charge also increases as a function of temperature. This pyroelectric effect is quite significant, the apparent surface voltage on the ferro-electric recording member being raised by up to one order by a modest rise in temperature and falling as the temperature is lowered. Indeed, if the temperature is further lowered the surface voltage may fall to zero, and subsequently to the reverse polarity.

In accordance with a feature of the invention, this phenomenon is used and applied for transfer of image deposits from ferro-electric recording member surfaces. In initial experiments a standard polarised image was toned and then lightly pressure transferred to paper. This was achieved by placing the paper on the toned ferro-electric material and transfer attempted by rolling a small metal roller over the rear surface of the paper. A very low resolution image of the background deposit was transferred to the paper, the image deposit being retained on the ferro-electric surface. The metal roller was then immersed in a slurry of dry ice and acetone and allowed to reach a temperature of approximately 0° C. The previously used transfer method was then repeated using the chilled roller. Good transfer of the image deposit was achieved with no loss of resolution. No transfer voltage was used in either instance.

A further set of experiments was then carried out to determine the most efficient temperature for transfer. In this experimental series the ferro-electric recording member was heated to 25° C. prior to imaging. The image was toned using a liquid dispersed toner which was poured over the surface. No precautions were taken to remove background fog. A transfer member comprising a paper sheet was placed over the imaged recording member and held in contact therewith using a 100 gram weight as the variable temperature pressure applicator. It was found that when the temperature of the weight was 25° C., that is the same as the temperature of the recording member, only the background fog was transferred to the transfer member. The temperature of the pressure applicator was then lowered to various temperatures for subsequent tests. It was found that fair to good image transfer was obtained at 20° C., with a marked increase in transfer efficiency in terms of image quality at 15° C. This increase in image resolution became very apparent at 10° C. With regards background fog, it was found that the density of transfer decreased as the temperature was lowered, the lower the temperature the lower the background density of the transferred image. Further temperature reduction gave minor improvements in image quality and reduction of background fog.

In these static tests it was found that high resolution image transfer with minimal background fog could be achieved with a temperature differential between the ferro-electric recording member and the transfer pressure applicator of 15° C., the transfer pressure applicator being at the lower temperature.

DRAWING

The single FIGURE is a highly schematic side view, in diagrammatic form, of an apparatus for continuous transfer of latent images on a ferro-electric recording member to a traveling substrate web, typically a paper web.

DETAILED DESCRIPTION

The application of these findings to continuous operation will now be described with reference to the drawing in which metal cylinder 1 has ferro-electric recording member 2, mounted on its outer surface, and is arranged to be rotated in the direction shown by the arrow in cylinder 1 by drive means not illustrated. Ferro-electric recording member 2 carries permanent electrostatic latent image 3 on the outer surface thereof.

Toner is applied onto the recording member 2 at a toner application station. Toner applicator roller 4, which rotates in the direction shown by the arrow 4' in roller 4, is mounted in close proximity to the surface of ferro-electric recording member 2. Tank 5, containing liquid dispersed electroscopic toner particles 6 is mounted below toner applicator roller 4 to allow toner applicator roller 4 to become coated with layer of liquid dispersed electroscopic toner particles 7 when toner applicator roller 4 is rotated. The layer of liquid dispersed electroscopic toner particles 7 on toner applicator roller 4 is of sufficient thickness to contact ferro-electric recording member 2 at toning gap 8, thereby allowing attraction of electroscopic toner particles 7 to electrostatic latent image 3 to form toned image deposit 9 on the surface of ferro-electric recording member 2.

In accordance with a feature of the invention, a cooling shoe 10 is provided, facing ferro-electric recording member 2 in the position shown. For the purpose of illustration the shoe 10 is chilled by passage of carbon dioxide into tubing mounted in cooling shoe 10 through inlet 11 and out through outlet 12. Paper web 13 is arranged to contact the cooled surface of ferro-electric recording member 2 by engagement with transfer or impression roller 14, to produce transferred toned image deposit 15 on the surface of paper web 13 at a transfer station. Warm air blower 16 is used to restore the initial surface temperature of ferro-electric recording member 2 and thus to restore the original polarity of electrostatic latent image 3 on the surface of ferro-electric recording member 2 prior to re-toning.

DESCRIPTION OF OPERATION TESTS

Using the apparatus illustrated in the Figure, a series of continuous operation test runs was carried out at various printing speeds. The surface temperature of the ferro-electric recording member was measured using an infra-red camera at a first position I immediately after toning at the application station and at a second position II immediately before transfer, that is before and after passage of the ferro-electric recording member past the cooling shoe 10. In each instance image transfer to the paper web was of high density with virtually no transfer at the transfer station of background fog. No transfer voltage was applied to the transfer roller 14. As illustrated in the Figure, a warm air blower 16 was used to raise the surface temperature of the ferro-electric recording member 2 after transfer and before retoning to restore the original polarity of the electrostatic latent image.

The following examples illustrate the actual operating parameters.

EXAMPLE 1

The printing speed was 0.1 m/second. The ferro-electric surface temperature after toning at position I was 19° C., which was reduced to 17° C. at position II before transfer, that is the temperature drop was 2° C.

EXAMPLE 2

The printing speed was 0.2 m/second. The ferro-electric surface temperature after toning was also 19° C., which was reduced to 17.5° C. before transfer, that is the temperature drop was 1.5° C.

EXAMPLE 3

The printing speed was 0.4 m/second. The ferro-electric surface temperature after toning was 19° C. which was reduced to 18° C. before transfer, that is the temperature drop was 1° C.

EXAMPLE 4

The printing speed was increased to 0.6 m/second. The ferro-electric surface temperature after toning was 19° C. which reduced to 18.5° C. before transfer, that is the surface temperature drop was 0.5° C.

The surface temperature differences necessary to achieve the apparent surface polarity reversal on the ferro-electric surface in continuous operation are thus surprisingly small, and in fact good transfer of the image deposit was obtained in other tests with a surface temperature drop of only 0.3° C. at a printing speed approaching 1 m/sec.

Other cooling and heating methods may be used in addition to those illustrated, such as for instance a Peltier Cell, the cold junctions of which may be used to cool the ferro-electric surface after toning and before transfer while air warmed in the vicinity of the hot junctions may be directed towards the ferro-electric surface after transfer and before retoning to restore the original polarity of the electrostatic latent image on the ferro-electric surface.

Virtually any liquid dispersed electroscopic toner suitable for transfer imaging may be used for the present invention. However a suitable toner is as described in Australian Provisional Patent Specification No PJ9452 now U.S. patent application Ser. No. 07/669,510 filed Mar. 14, 1991, LAWSON, entitled Toner for Electrophotography, the formulation of which is as now disclosed.

| | |
|---|---|
| Elvax 210 | 10 gms |
| Pentalyn H | 15 gms |
| 6% Zirconium Octoate | 10 gms |
| Isopar L | 250 gms |

The above ingredients are heated to 90° C. with stirring at slow speed to effect solution of the solid materials in the solvent, at which time is added

| | |
|---|---|
| Irgalite Blue LGLD | 15 gms |

Milling is then carried out at a temperature of 90°–100° C. in a heated attritor for 2 hours, after which heating is discontinued and milling continued while the composition cools to room temperature.

The toner concentrate is diluted to a working strength of 5 to 100 ml concentrate per liter of dispersant for use in the present invention.

Irgalite Blue LGLD is C1 Pigment Blue 15:3 supplied by Ciba-Geigy Australia Ltd.

Elvax 210 is an ethylene vinyl acetate copolymer, melt index 355–465, vinyl acetate content 27–29%, supplied by Union Carbide Australia Ltd.

Pentalyn H is a pentaerythritol ester of rosin, acid number 7–16, melting range 102°–110° C., supplied by A. C. Hatrick Chemicals Pty Ltd.

Isopar L is an isoparaffinic hydrocarbon, boiling range 190°–206° C., supplied by Exxon Chemical Australia Pty Ltd.

Not all ferro-electric materials are equally affected by changes in surface temperature. The foregoing disclosure relates to tests carried out using a lead zirconate titanate ferro-electric material.

It should be pointed out that the temperature differences disclosed in the examples are the maxima that could be achieved at the various speeds using the experimental equipment described. More efficient cooling and heating systems may well allow the achievement of greater temperature differentials to give further improved printing quality, or alternatively allow faster printing speed to be achieved.

I claim:

1. A method for the transfer of toned image deposits from a recording surface of a ferro-electric recording member (2) to a surface of a receiving member (13) at a transfer station, wherein the ferro-electric member has a latent image (3) recorded on said recording surface in the form of polarized ferro-electric domains, comprising the steps of providing a source of supply (6, 4, 7) of toner particles dispersed in a liquid, said toner particles being at a first temperature, at a toner application station, physically applying the toner particles dispersed in the liquid onto the recording surface having said polarized domains of the ferro-electric recording member (2) via a gap (8) between said recording surface of the ferro-electric recording member (2) and the source of supply (6, 4, 7) of said liquid-dispersed toner particles, for toning the latent image on said ferro-electric surface by attraction thereto of said toner particles, to form toned image deposits on said recording surface of the ferro-electric recording member (2) thereon, at said first temperature;

cooling said recording surface of the ferro-electric recording member (2) containing said toned image deposits to a second, and lower temperature, to thereby establish a lower temperature of said recording surface than said first temperature by positioning a cooling means (10, 11) in close proximity to said toned ferro-electric recording member (2) at a position (I) following the toner applying step at the toner application station; and immediately thereafter transferring said toned image deposits at a transfer station from said cooled recording surface of said ferro-electric recording member (2) to the receiving member (13) by contact of said receiving member with said cooled recording surface of said ferro-electric recording member (2), and wherein said cooling step comprises lowering the temperature by at least 0.3° C., whereby said second temperature will be lower by at least 0.3° C. than said first temperature.

2. The method of claim 1, further comprising relatively moving the recording member (2) and the receiving member (13) to define a printing speed; and wherein the printing speed is 0.1 m/second and said second lower temperature is about 2° C. lower than said first temperature.

3. The method of claim 1, further comprising relatively moving the recording member (2) and the receiving member (13) to define a printing speed; and wherein the printing speed is 0.2 m/second and said second lower temperature is about 1.5° C. lower than said first temperature.

4. The method of claim 1, further comprising relatively moving the recording member (2) and the receiving member (13) to define a printing speed; and wherein the printing speed is 0.4 m/second and said second lower temperature is about 1° C. lower than said first temperature.

5. The method of claim 1, further comprising relatively moving the recording member (2) and the receiving member (13) to define a printing speed; and wherein the printing speed is 0.6 m/second and said second lower temperature is about 0.5° C. lower than said first temperature.

6. The method of claim 1, further comprising the step of raising the surface temperature of said ferro-electric recording member (2) at a position following the transfer station (14), and preceding the toner application station (5, 6, 4).

7. The method of claim 1, wherein said ferro-electric recording member (2) comprises a lead zirconate titanate ferro-electric material.

8. The method of claim 1, wherein said cooling step comprises passing carbon dioxide through the cooling means (10, 11).

9. The method of claim 1, wherein said cooling step comprises placing a cold junction of a Peltier cell in close proximity to said ferro-electric recording member (2) at a position following said toner application station.

10. The method of claim 1, wherein the step of physically applying the toner particles, via the gap (8), comprises interposing a transfer roller (4) between a body of liquid-dispersed toner particles (6) and said recording surface of the ferro-electric recording member (2), and immersing said transfer roller in said body of liquid (6) and rotating said transfer roller (4) with its surface (7) in close proximity to, but spaced by said gap (8) from, said recording surface of said ferr0-electric recording member (2).

* * * * *